US010063003B2

(12) United States Patent
Bhosale et al.

(10) Patent No.: US 10,063,003 B2
(45) Date of Patent: Aug. 28, 2018

(54) TAMPER-RESISTANT ELECTRICAL WIRING DEVICE SYSTEM

(71) Applicant: Leviton Manufacturing Co., Inc., Melville, NY (US)

(72) Inventors: Vikramsinh P. Bhosale, Westbury, NY (US); Michael Mattei, Saint James, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 0 days.

(21) Appl. No.: 15/380,447

(22) Filed: Dec. 15, 2016

(65) Prior Publication Data

US 2018/0175539 A1 Jun. 21, 2018

(51) Int. Cl.

| | |
|---|---|
| ***H01R 13/44*** | (2006.01) |
| ***H01R 13/453*** | (2006.01) |
| ***H01R 13/11*** | (2006.01) |
| *H01R 103/00* | (2006.01) |
| *H01R 24/22* | (2011.01) |

(52) U.S. Cl.

CPC ..... *H01R 13/4534* (2013.01); *H01R 13/11* (2013.01); *H01R 13/112* (2013.01); *H01R 24/22* (2013.01); *H01R 2103/00* (2013.01)

(58) Field of Classification Search

CPC ..... H01R 13/4534
USPC ..... 439/137
See application file for complete search history.

(56) References Cited

U.S. PATENT DOCUMENTS

| | | | | |
|---|---|---|---|---|
| 3,238,492 A * | 3/1966 | Douglas | H01R 13/4534 439/137 |
| 4,822,290 A | 4/1989 | Cauley et al. | |
| 5,146,385 A | 9/1992 | Misencik | |
| 5,396,062 A | 3/1995 | Eisentraut et al. | |
| 5,413,501 A | 5/1995 | Munn | |

(Continued)

FOREIGN PATENT DOCUMENTS

| | | |
|---|---|---|
| GB | 719387 A | 12/1954 |
| GB | 2287842 A | 9/1995 |

(Continued)

OTHER PUBLICATIONS

PCT International Search Report and Written Opinion from PCT/US2017/064415 dated Mar. 21, 2018.

*Primary Examiner* — Tulsidas C Patel
*Assistant Examiner* — Peter G Leigh

(57) ABSTRACT

A tamper resistant (TR) mechanism for use in a receptacle is disclosed. The TR mechanism movable between a first or blocking position and a second position wherein a two-bladed plug with a ground pin may contact the underlining conductive terminals so that electricity can flow to the electrical plug. The TR mechanism may include first and second sliders for blocking the openings formed in the receptacle, first and second locking tabs, and a ground pin slider partially located with a ground plug opening formed in the receptacle. In use, inserting the ground pin causes the ground pin slider to move to a second ground pin slider position, which causes the first and second locking tabs to align with a stem portion of the ground pin slider. Thereafter, contacting the first and second sliders with the two-bladed plug causes the first and second sliders to move to their second position.

23 Claims, 7 Drawing Sheets

(56) References Cited

U.S. PATENT DOCUMENTS 5,791,931 A * 8/1998 Burkhart, Sr. ..... H01R 13/20 439/304
5,839,909 A * 11/1998 Calderara ..... H01R 13/4534 439/137
6,149,446 A 11/2000 Yu
6,699,050 B1 * 3/2004 Wong ..... H01R 13/443 174/67
6,932,631 B2 * 8/2005 Huang ..... H01R 13/4536 439/143
7,312,394 B1 * 12/2007 Weeks ..... H01R 13/4534 174/53
7,355,117 B2 4/2008 Castaldo et al.
7,554,033 B1 6/2009 Bhosale et al.
7,642,457 B2 * 1/2010 Weeks ..... H01R 13/4534 174/53
7,736,174 B2 6/2010 Bhosale et al.
7,753,700 B2 * 7/2010 Ma ..... H01R 13/4534 439/133
7,820,909 B2 10/2010 Castaldo et al.
7,868,719 B2 1/2011 Bazayev et al.
7,985,085 B2 * 7/2011 Gao ..... H01R 13/4534 439/137
8,044,299 B2 10/2011 Weeks
8,435,055 B1 * 5/2013 Bhosale ..... H01R 13/4534 439/145
9,112,321 B2 8/2015 Bhosale et al.
2002/0112945 A1 8/2002 Lawson et al.
2007/0211397 A1 9/2007 Sokolow et al.
2008/0224835 A1 9/2008 Noest
2009/0032278 A1 2/2009 Weeks et al.
2009/0052162 A1 2/2009 Richter et al.
2011/0104919 A1 5/2011 Patel et al.
2012/0115372 A1 5/2012 Bazayev et al.
2013/0109207 A1 * 5/2013 Bhosale ..... H01R 13/4534 439/137
2016/0013577 A1 * 1/2016 Diakomis ..... H01R 13/4534 439/138
2016/0104963 A1 * 4/2016 Savicki, Jr. ..... H01R 25/006 439/138
2016/0261079 A1 * 9/2016 Lin ..... H01R 13/703

FOREIGN PATENT DOCUMENTS

GB 2374988 A 10/2002
GB 2464138 A 4/2010

* cited by examiner

TAMPER-RESISTANT ELECTRICAL WIRING DEVICE SYSTEM

FIELD OF THE DISCLOSURE

The present disclosure relates generally to a tamper-resistant mechanism for use with an electrical wiring device and, more particularly, to a tamper-resistant mechanism for use solely with a two bladed plug having a ground pin.

BACKGROUND OF THE DISCLOSURE

Electrical power may be transmitted from a source to a point of use through an electrical distribution system within a home or a commercial building for equipment and operations. Conventional electrical receptacles within such a distribution system generally include a cover having one or more sockets, a body to which the cover is secured to provide a housing for internal conductive terminals corresponding to respective Hot (phase) and Neutral of an alternating current power source and each situated in respective alignment with respective blade openings formed in the sockets of the cover for receiving corresponding blades, including polarized blades, of an electrical plug. The receptacle may also include an electrical ground terminal within the body in alignment with a pin opening formed in each respective socket for receiving a corresponding ground pin of the electrical plug. For example, the receptacle may include a strap sub-assembly. The strap may include structures, e.g., slots, pins, etc., that permit the receptacle to be mounted to threaded mounting holes of a standard outlet box. The strap may be affixed to the body by a center pin shaft and pin or mounting screw that additionally affixes the cover to the body. A bushing for a mounting screw is provided for securing the body to the cover.

Further, since a large percentage of these receptacles are used in residential buildings and are located near the floor, it may be beneficial to provide added protection when a young child or infant may come into contact with the receptacle. For example, a small object inserted into either one of the apertures potentially may result in electrical shock.

Children may insert into receptacles a wide variety of objects made of conductive material including but not limited to metal articles. Most objects may be everyday household and easily accessible items such as paper clips, pens, wire tools, hairpins, safety pins, keys, forks, knives, screws, nails, tweezers and coins.

Both scenarios present circumstances to be avoided, where possible. As such, the issue of human safety and avoiding hazards has always been considered by the owner of the instant application in developing new products. Further, in an effort to eliminate the foregoing, the National Electrical Code (NEC) now requires tamper-proof electrical receptacles in pediatric environments. A National Electrical Manufacturer's Association (NEMA) task force has concluded that every residential building should be required to have tamper-resistant (TR) electrical receptacles within the electrical distribution system throughout the home.

As a result, it is known in the art to incorporate a TR mechanism to prevent improper use of the electrical receptacle. Generally speaking, the use of TR mechanisms has become wide spread. TR mechanisms provide a simple and effective mechanism that does not need continuous manual adjustment. TR mechanisms prevent electric shock when one inserts an object into one aperture in the cover, while still permitting the frequent insertion and removal of plugs to an electrical appliance.

Furthermore, in recent times, as the use of three prong receptacles including a Hot (phase) blade opening, a Neutral blade opening and a ground pin opening formed in the cover for receiving corresponding blades of an electrical plug, it would be beneficial to provide a TR mechanism that prevents the insertion of two bladed plugs that do not include a ground pin.

Thus, it would be desirable to provide a TR mechanism that prevents the insertion of a conductive material into a single blade opening while also preventing the insertion of a two bladed plug into a three prong receptacle.

SUMMARY OF THE DISCLOSURE

The present disclosure is directed to a tamper resistant (TR) mechanism for use in a receptacle. The receptacle may include a cover having a plurality of blade openings and a ground pin opening for receiving a two-bladed electrical plug with a ground pin. The TR mechanism may include a slider, a locking tab and a ground pin slider. The slider may be movable from a first slider position to a second slider position. In the first slider position, the slider blocks the plurality of blade openings, while in the second slider position, the slider permits passage of the two-bladed electrical plug thru the plurality of blade openings. The locking tab may be movable from a first tab position to a second tab position. In the first tab position, the locking tab prevents the slider from moving to the second slider position. The ground pin slider may be movable from a first ground pin slider position to a second ground pin slider position. The ground pin slider may at least partially obstruct the ground pin opening, when the ground pin slider is in the first ground pin slider position, so that insertion of the ground pin causes the ground pin slider to move from the first ground pin slider position to the second ground pin slider position. In use, when the ground pin slider is in the second ground pin slider position, the locking tab is movable from the first tab position to the second tab position to permit the slider to move from the first slider position to the second slider position. The slider may be biased towards the first slider position, and the ground pin slider may be biased towards the first ground pin slider position.

The slider may include a first slider associated with a first of the plurality of blade openings and a second slider associated with a second of the plurality of blade openings wherein each of the first and second sliders may be movable from the first slider position to the second slider position. The locking tab may include a first locking tab associated with the first slider and a second locking tab associated with the second slider wherein each of the first and second locking tabs may be movable from the first tab position to the second tab position such that when the ground pin slider is in the second ground pin slider position, the first and second locking tabs are movable from the first tab position to the second tab position to permit the first and second sliders to move from the first slider position to the second slider position.

The ground pin slider may include a first end, a second end and an intermediate stem disposed between the first end and the second end. The first end may be at least partially located within the ground pin opening when the ground pin slider is in the first ground pin slider position. The second end of the ground pin slider may be connected to a first biasing member for biasing the ground pin slider towards the first ground pin slider position. The second end of the ground pin slider may include a recess for receiving a portion of a spring. The first end of the ground pin slider may include a ramped surface for contacting the ground pin. In the first ground pin slider position, the second end of the ground pin slider may prevent the first and second locking tabs from moving from the first tab position to the second tab position. In the second ground pin slider position, the first and second locking tabs may be aligned with the stem of the ground pin slider, thus permitting the first and second locking tabs to move laterally towards the stem of the ground pin slider so that the first and second locking tabs are permitted to move from the first tab position to the second tab position. The second end of the ground pin slider may include a width greater than a width of the stem so that when in the second ground pin slider position, the first and second locking tabs are permitted to move towards the stem. The ground pin slider may include a sloped transition connecting the stem to the second end.

The ground pin slider may be biased towards the first ground pin slider position by a first coil spring and the first and second sliders may be biased towards the first slider position by second and third coil springs.

The first and second sliders may each include an outer sloped surface so that when the ground pin slider is in the second ground pin slider position, insertion of a two-bladed plug causes the first and second sliders to move to the second slider position.

In the first tab position, the first end of the first locking tab may be in contact with the ground pin slider and the second end of the first locking tab may be received within a recess formed in the first slider. Similarly, the first end of the second locking tab may be in contact with the ground pin slider and the second end of the second locking tab may be received within a recess formed in the second slider. In the second tab position, the first end of the first locking tab may be aligned with the stem of the ground pin slider and the first end of the second locking tab may be aligned with the stem of the of the ground pin slider so that the first and second sliders are movable from the first slider position to the second slider position. Moving the first and second sliders from the first slider position to the second slider position may cause the first and second sliders to contact the first and second locking tabs so that the first and second locking tabs move from the first tab position to the second tab position.

The TR mechanism may also include a base for supporting the first and second sliders, the first and second locking tabs, and the ground pin slider.

In the first slider position, the first and second sliders may block the plurality of blade openings to prevent access to first and second conductive terminals located in the receptacle. In the second slider position, the first and second sliders may permit passage thru the plurality of blade openings so that the two-bladed electrical plug can contact the first and second conductive terminals located in the receptacle.

In an alternate embodiment of a tamper resistant (TR) mechanism, the TR mechanism may include first and second sliders, first and second locking tabs, and a ground pin slider. The first and second sliders may be movable from a first slider position to a second slider position. In the first slider position, the first and second sliders may block the plurality of blade openings. In the second slider position, the first and second sliders may enable passage of the two-bladed electrical plugs thru the plurality of blade openings. Each of the first and second locking tabs may be movable from a first tab position to a second tab position. In the first tab position, the first and second locking tabs may restrict the first and second sliders to prevent the first and second sliders from moving to the second slider position, respectively. The ground pin slider may be movable from a first ground pin slider position to a second ground pin slider position. The ground pin slider may at least partially obstruct the ground pin opening so that insertion of the ground pin causes the ground pin slider to move from the first ground pin slider position to the second ground pin slider position. In the first ground pin slider position, the ground pin slider may prevent the first and second locking tabs from moving to the second tab position.

In use, insertion of a two-bladed electrical plug with a ground pin causes the ground pin to contact the ground pin slider so that the ground pin slider moves from the first ground pin slider position to the second ground pin slider position and causes the two-blades to contact the first and second sliders so that the first and second sliders move from the first slider position to the second slider position, which causes the first and second locking tabs to move from the first tab position to the second tab position.

The first and second sliders may be biased towards the first slider position, and the ground pin slider may be biased towards the first ground pin slider position so that upon removal of the two-bladed electrical plug with ground pin causes the first and second sliders to move to the first slider position and the ground pin slider to move to the first ground pin slider position, which causes the first and second locking tabs to move to the first tab position.

In an alternate embodiment of a tamper resistant (TR) mechanism, the TR mechanism may include at least one slider, at least one locking tab and a ground pin slider. The at least one slider may be movable from a first slider position to a second slider position. In the first slider position, the at least one slider may block access to the plurality of blade openings. In the second slider position, the at least slider may enable passage of the two-bladed electrical plug thru the plurality of blade openings. The at least one locking tab may be movable from a first tab position to a second tab position. In the first tab position, the at least one locking tab may prevent the at least one slider from moving to the second slider position. The ground pin slider may be movable from a first ground pin slider position to a second ground pin slider position. The ground pin slider may at least partially obstruct the ground pin opening so that insertion of the ground pin causes the ground pin slider to move from the first ground pin slider position to the second ground pin slider position.

In use, when the ground pin slider is in the second ground pin slider position, the at least one locking tab is movable from the first tab position to the second tab position to permit the at least one slider to move from the first slider position to the second slider position.

The at least one slider may be biased towards the first slider position, and the ground pin slider may be biased towards the first ground pin slider position.

BRIEF DESCRIPTION OF THE DRAWINGS

By way of example, specific embodiments of the disclosed device will now be described, with reference to the accompanying drawings, in which.

DETAILED DESCRIPTION

Figure 1:
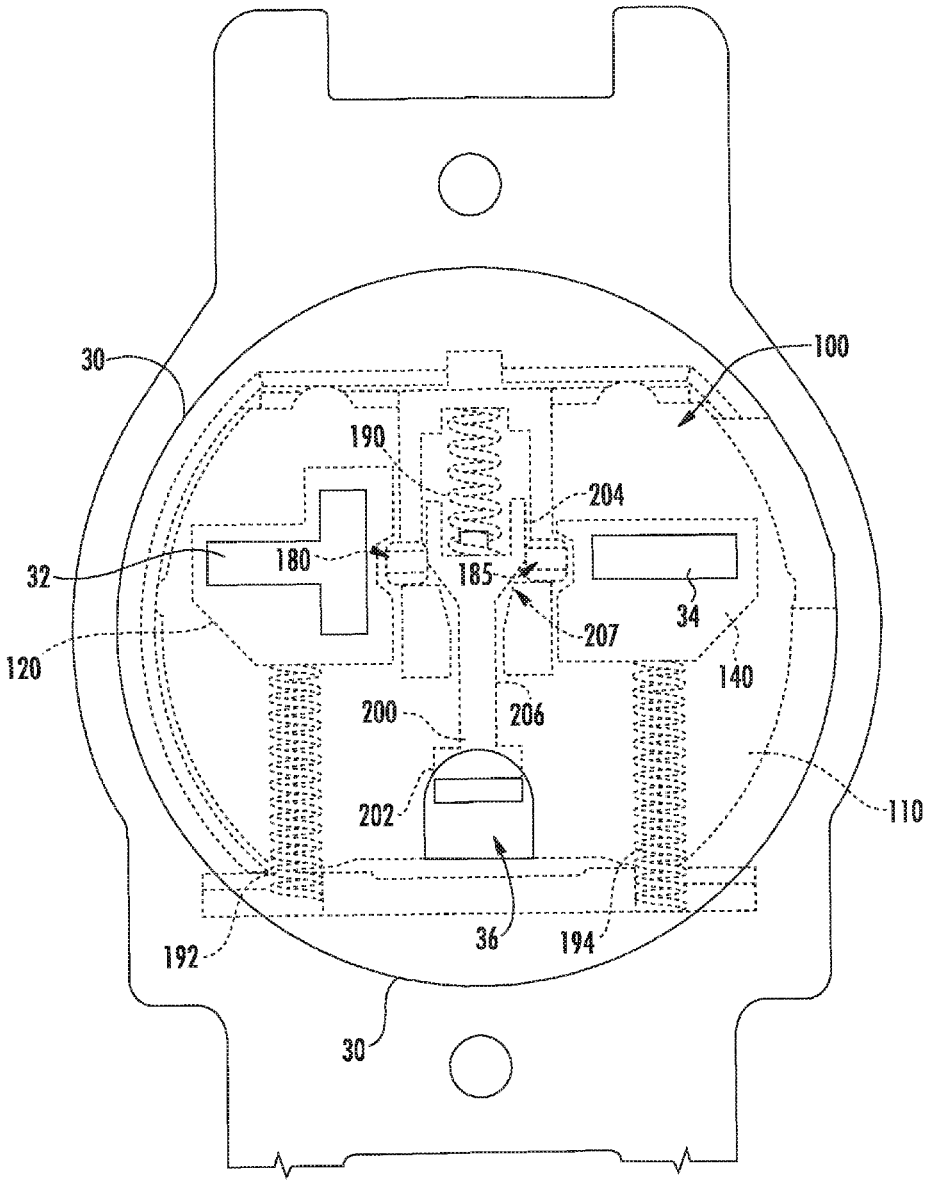
FIG. 1 is a front view of a cover housing an exemplary embodiment of a tamper resistant (TR) mechanism; the TR mechanism shown in a first or blocking position.

A device, system and method in accordance with the present disclosure will now be described more fully hereinafter with reference to the accompanying drawings, in which preferred embodiments of the device, system and method are shown. The disclosed device, system and method, however, may be embodied in many different forms and should not be construed as being limited to the embodiments set forth herein. Rather, these embodiments are provided so that this disclosure will be thorough and complete, and will fully convey the scope of the devices, system and method to those skilled in the art. In the drawings, like numbers refer to like elements throughout.

The present disclosure relates to a tamper proof or tamper resistant (TR) mechanism 100 for use in connection with a receptacle. In the embodiment described by way of example herein, the TR mechanism 100 is shown in use with a 250 v receptacle for electrically receiving a two-bladed electrical plug with a ground pin for handling 20 amp current applications. However, it should be understood that the present disclosure is directed to a TR mechanism for use with a two-bladed electrical plug with a ground pin. As such, it is contemplated that the present disclosure can be used in any other application involving a two-bladed electrical plug with a ground pin. For example, the receptacle may include ground fault circuit interrupter (GFCI) and/or surge suppression capabilities. Moreover, the receptacle can be selected to handle other current capacities such as 15 amps, 30 amps, 50 amps and other capacities. The TR mechanism 100 could be incorporated into the body of the receptacle, or it could be provided in a separate cover mechanism. Further, while the description herein is provided with reference to an example electrical receptacle having a socket that receives a plug connected to an electrical load, it is equally applicable to other devices that have a receptacle that are in combination with, including, but not limited to, switches, dimmers, sensors, lighting controls, and combinations thereof, of single gang and multi-gang varieties. In addition, the receptacle may be configured with multiple sockets in each device.

Figure 6:
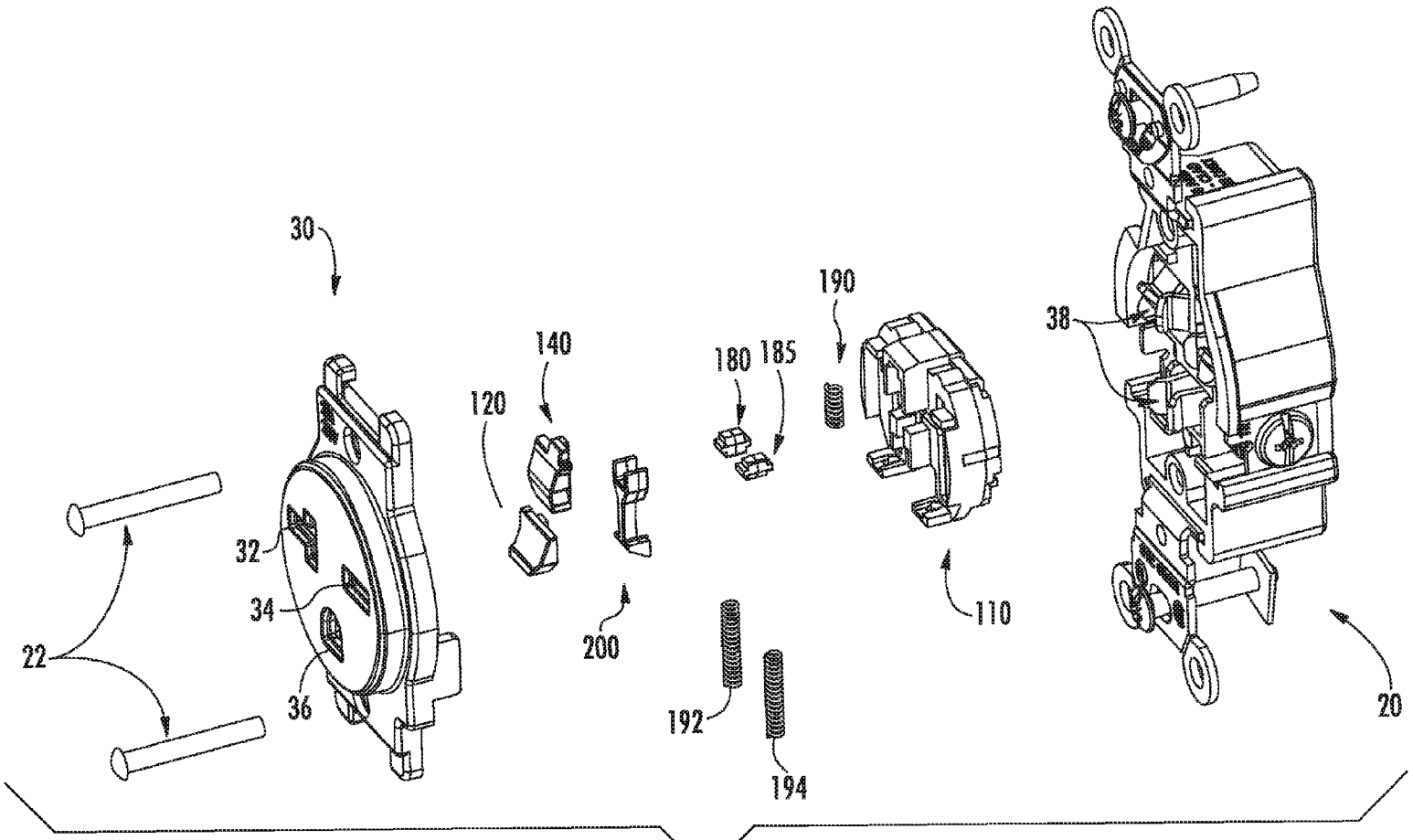
FIG. 6 is an exploded perspective view of the exemplary embodiment of the TR mechanism shown in FIG. 1.

As will be appreciated by one of ordinary skill in the art, the receptacle may include a housing including a cover 30 and a body 20 (as best shown in FIG. 6). The cover 30 may include one or more sockets including blade openings 32, 34 for receiving corresponding blades of an electrical plug. The cover 30 may also include a ground pin opening 36 for receiving a ground pin of the electrical plug. It will be appreciated that the receptacle also includes respective internal conductive terminals 38 provided and disposed in the body 20. The internal conductive terminals 38 may be coupled with respective phased and neutral terminals of a power source, e.g., as supplied to a home, business or hospital, to provide respective hot or single phase power and neutral or return terminals within the receptacle. Further, the receptacle may also include an internal conductive ground terminal within the housing. For example, the receptacle may include a metal plate or strap assembly for providing a receptacle ground by connecting to a ground potential of a power source (not shown).

In general, the blade openings 32, 34 align with the electrically conductive terminals 38 provided within the body 20 for receiving and engaging blades of the electrical plug. The ground pin opening 36 aligns with the conductive ground terminal disposed within the body 20 for receiving and engaging a respective ground pin of the electrical plug.

Each of the conductive terminals 38 provide respective phase (Hot) terminals, and neutral terminals for receiving blades of a plug for use in powering an electrical device. In one embodiment, these conductive terminals may include screw terminals for receiving, at the back of the housing, direct wire connections from power terminals, as supplied to homes, businesses or hospitals.

The cover 30 may be solid, translucent or partially translucent and may include snap-fit structures at each distal end for coupling to or otherwise engaging respective receiving structures at respective ends of a solid, translucent or partially translucent body to provide a secure housing or enclosure for the electrical receptacle. In one embodiment, the body 20 and cover 30 materials may be manufactured from thermoplastic such as, for example, nylon, polycarbonate, etc. The cover 30 may be coupled to the body 20 via one or more rivets 22 however, it is contemplated that the cover 30 may be coupled to the body 20 by any other mechanism including, for example, screws.

Within the housing, there may also be disposed beneath the cover, a tamper resistant (TR) mechanism 100 aligned with the blade openings 32, 34 and the ground pin opening 36 formed in the cover 30. In the illustrated embodiment the TR mechanism 100 is operatively situated beneath the respective blade openings 32, 34 and the ground pin opening 36 formed in the cover 30 to prevent insertion of a device into the openings 32, 34, 36 of a respective socket and into contact with the underlining conductive terminals 38 within the housing of the receptacle. It should be noted, while a single socket will be shown and described, it is contemplated that more than one socket, and hence TR mechanism, may be used in connection with each receptacle.

Generally speaking, the TR mechanism may include a slider, a locking tab and a ground pin slider. In use, the slider may be movable from a first slider position to a second slider position. In the first slider position, the slider is adapted and configured to block access thru the plurality of blade openings in the receptacle, while in the second slider position, the slider permits passage of the two-bladed electrical plug thru the plurality of blade openings and into engagement with the underlining conductive terminals. The locking tab may also be movable from a first tab position to a second tab position. In the first tab position, the locking tab prevents the slider from moving to the second slider position. The ground pin slider may also be movable from a first ground pin slider position to a second ground pin slider position. In use, the ground pin slider may be at least partially located within the ground pin opening to at least partially obstruct the ground pin opening so that when the ground pin slider is in the first ground pin slider position, insertion of a ground pin on a two-bladed plug with a ground pin causes the ground pin slider to move from the first ground pin slider position to the second ground pin slider position. Movement of the ground pin slider to the second ground pin slider position enables the locking tab to be movable from the first tab position to the second tab position to permit the slider to move from the first slider position to the second slider position.

Referring to FIGS. 1-10, an exemplary embodiment of a TR mechanism 100 in accordance with the present disclosure is shown. As shown, in the exemplary embodiment, the slider may be in the form of a two-piece slider (e.g., a first slider 120 associated with a first blade opening and a second independent slider 140 associated with a second blade opening). Similarly, the locking tab may be in the form of a two-piece locking tab (e.g., a first locking tab 180 associated with the first slider 120 and a second independent locking tab 185 associated with the second slider 140). In use, insertion of a ground pin on a two-bladed plug with a ground pin causes the ground pin slider 200 to move from the first ground pin slider position to the second ground pin slider position. Movement of the ground pin slider 200 to the second ground pin slider position enables both of the first and second locking tabs 180, 185 to be movable from the first tab position to the second tab position, thus permitting each of the first and second sliders 120, 140 to move from the first slider position to the second slider position.

More specifically, the TR mechanism 100 may include a base 110, first and second sliders 120, 140, a ground pin slider 200, first and second locking tabs 180, 185, and a plurality of biasing members (e.g., shown as first, second and third biasing members) 190, 192, 194. The base 110 may be adapted and configured to support the first and second sliders 120, 122, the ground pin slider 200, the first and second locking tabs 180, 185, and the plurality of biasing members 190, 192, 194 while enabling them to move as required.

In use, the first and second sliders 120, 140, the ground pin slider 200, the first and second locking tabs 180, 185 and the plurality of biasing members 190, 192, 194 are arranged on the base 110 so that, when the TR mechanism 100 is properly located with respect to the receptacle, the first and second sliders 120, 140 block access to the internal conductive terminals (e.g., Hot and Neutral terminals) and the ground pin slider 200 at least partially obstructs access to the internal ground terminal located in the receptacle to prevent a child or anyone else from inserting an object into one of the blade openings 32, 34 formed in the socket of the cover 30. However, the TR mechanism 100 is preferably designed so that when a user properly inserts a two-bladed plug with a ground pin into the blade and ground pin openings 32, 34, 36, the TR mechanism 100 moves from a first or blocking position (FIGS. 1-3) to a second position (FIG. 5) to enable the two-bladed plugs 42, 44 and the ground pin 46 to contact the internal conductive terminals located in the receptacle.

Figure 3:
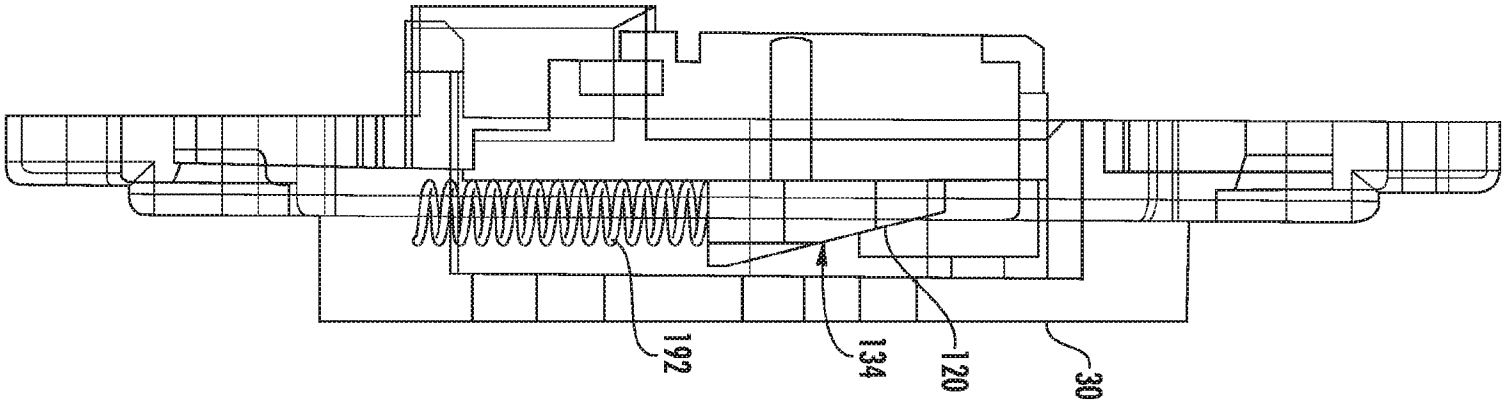
FIG. 3 is a side cross-sectional view of the TR mechanism of FIG. 1, the TR mechanism shown in the first or blocking position.
Figure 4:
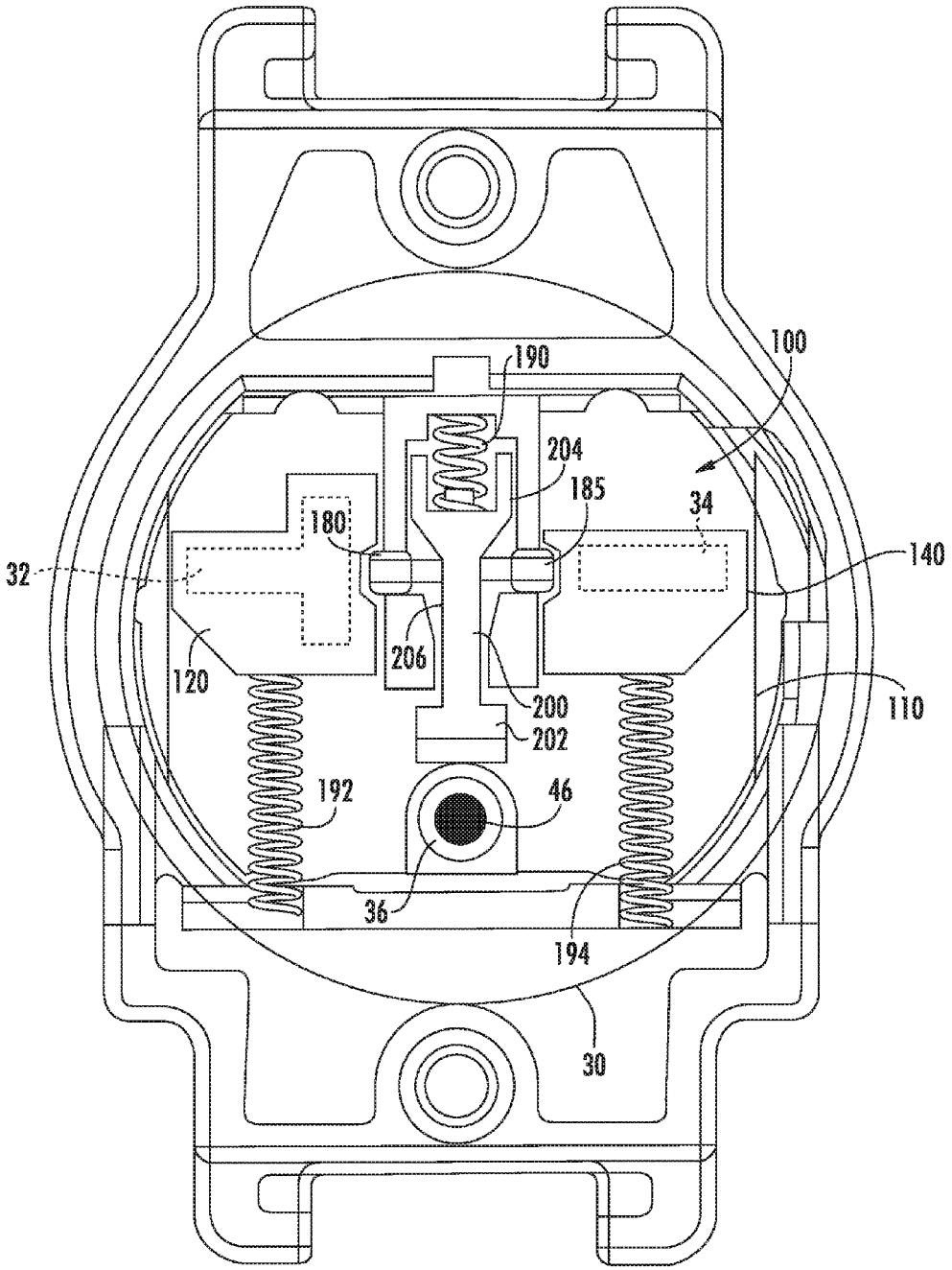
FIG. 4 is a rear view of the TR mechanism of FIG. 1, the TR mechanism shown in an intermediate position with a ground pin inserted and a ground pin slider in a second position.
Figure 5:
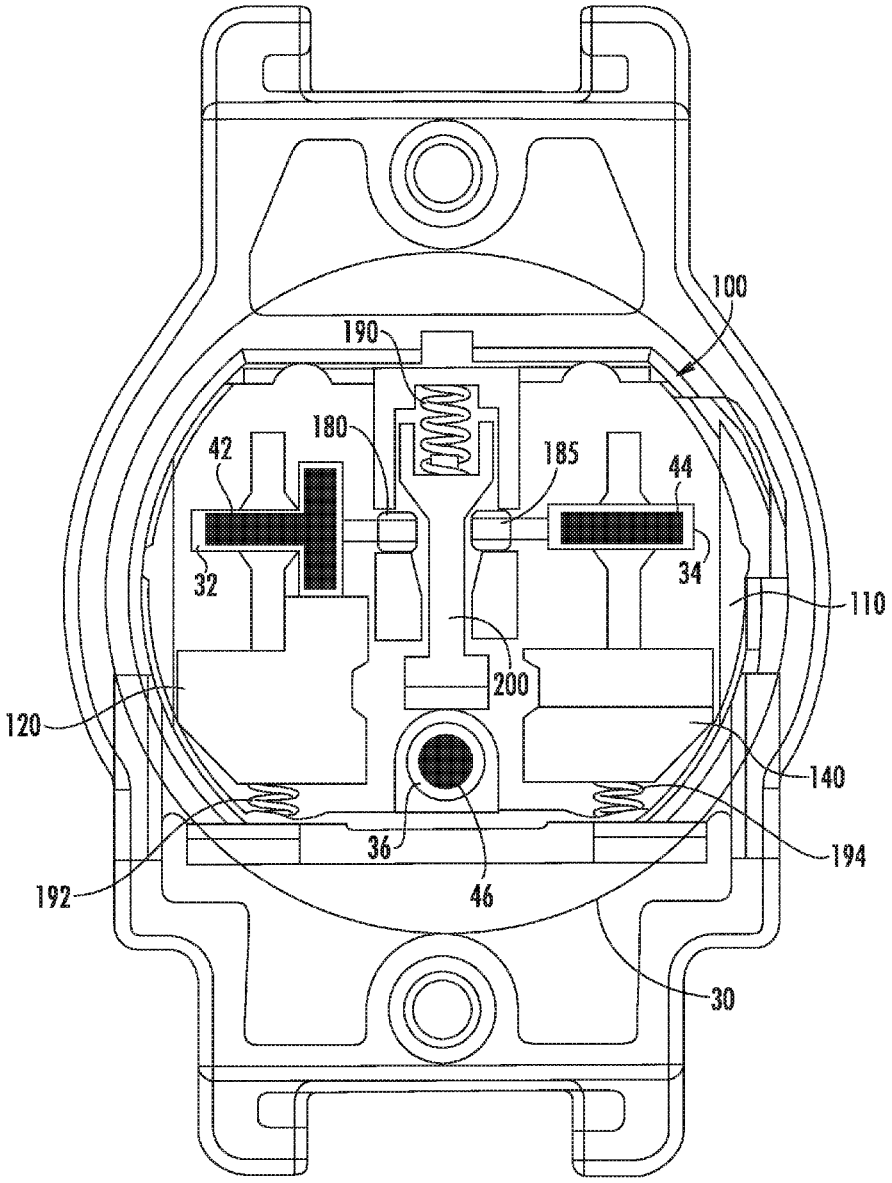
FIG. 5 is a rear view of the TR mechanism of FIG. 1, the TR mechanism shown in the second position with the two-bladed plugs and the ground pin fully inserted into the receptacle.

That is, generally speaking, in the first or blocking position (FIGS. 1-3), the ground pin slider 200 may be adapted and configured to at least partially obstruct, restrict, or overlap with the ground pin opening 36 formed in the cover 30. As will be appreciated by one of ordinary skill in the art, according to national energy codes, for safety reasons, a ground pin 46 formed on a two-bladed plug with a ground pin is longer than the Hot and Neutral blades 42, 44. With this in mind, the TR mechanism 100 was designed so that entry of the ground pin 46 into the ground opening 36 causes the ground pin slider 200 to move from a first or blocking position (FIGS. 1-3) to a second position (FIGS. 4 and 5). When in the second position (FIGS. 4 and 5), the ground pin slider 200 enables the first and second locking tabs 180, 185 to move out of engagement with the first and second sliders 120, 140, which in turns permits the first and second sliders 120, 140 to move via contact with the Hot and Neutral blades 42, 44 of the plug. Thus, permitting insertion of a two-bladed plug with ground pin into electrical contact with the receptacle.

In use, the first, second and third biasing members 190, 192, 194 are disposed to contact the first, second and ground pin sliders 120, 140, 200 to bias the TR mechanism 100 to the first or blocking position (FIGS. 1-3) wherein the first and second sliders 120, 140 block access to the underlining conductive Hot and Neutral terminals and the ground pin slider 200 obstructs access to the underlining ground terminal. In this manner, if a child or anyone else attempts to insert an object into one of the openings formed in the cover of the receptacle, the first and second sliders 120, 140 would prevent insertion. Only with the proper insertion of a two-bladed plug with a ground pin would the TR mechanism 100 move from the first or blocking position (FIGS. 1-3) to the second position (FIG. 5) to enable the ground pin 46 to contact the underlining ground terminal and the two blades 42, 44 to contact the underlining Hot and Neutral terminals.

Figure 7:
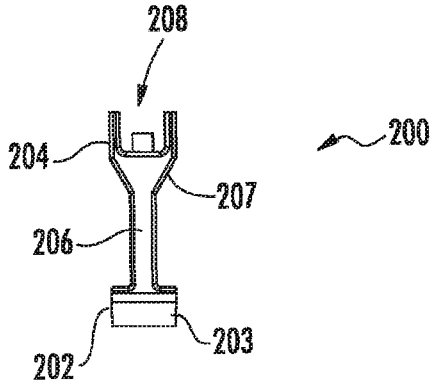
FIG. 7 is a front view of an exemplary embodiment of a ground pin slider used in connection with the TR mechanism shown in FIG. 6.

Referring to FIGS. 1 and 7, the ground pin slider 200 may include a first end 202, a second end 204, and an intermediate stem 206 extending from the first end 202 to the second end 204. The first end 202 may include a ramped surface 203 for facilitating contact with the ground pin 46 of a two-bladed plug with a ground pin. The second end 204 may be adapted and configured to contact a first biasing member 190. More specifically, as shown, the second end 204 may include a recess 208 for receiving a portion of the first biasing member 190. In addition, the second end 204 may be wider than the stem 206, as such, the ground pin slider 200 may include a transition 207 from the narrower stem 206 to the wider second end 204. In use, the first end 202 is adapted and configured to reside, at least partially, within the ground pin opening 36 formed in the cover 30, when in the first or blocking position. The first biasing member 190 preferably biases the ground pin slider 200 into the first or blocking position.

In addition, when in the first or blocking position, the second end 204 of the ground pin slider 200 is adapted and configured to prevent the first and second locking tabs 180, 185 from releasing the first and second sliders 120, 140. For example, the second end 204 of the ground pin slider 200 may contact, restrict and/or prohibit the first and second locking tabs 180, 185 so that the first and second locking tabs 180, 185 cannot move in a horizontal direction. However, when a two-bladed plug with a ground pin is inserted into the receptacle through the TR mechanism 100, the ground pin 46 contacts the first end 202 of the ground pin slider 200. As a result of the interaction between the ground pin 46 and the ramped surface 203 formed on the first end 202 of the ground pin slider 200, the ground pin slider 200 moves upwards against the biasing force of the first biasing member 190 (see FIG. 4 which illustrates the initial insertion of a ground pin 46 into the ground pin opening 36). Upwards movement of the ground pin slider 200 allows the first and second locking tabs 180, 185 to align with the narrower stem 206. As a result, the first and second locking tabs 180, 185 are no longer blocked by the second end portion 204 of the ground pin slider 200 and thus have the required clearance to permit the tabs 180, 185 to move laterally inwards, towards the stem 206 of the ground pin slider 200 and thus permitting movement of the first and second sliders 120, 140.

Figure 8A:
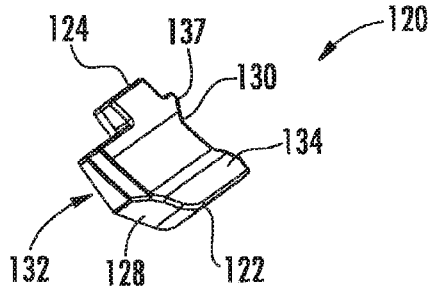
FIG. 8A is a perspective view of an exemplary embodiment of a first slider used in connection with the TR mechanism shown in FIG. 6.
Figure 8B:
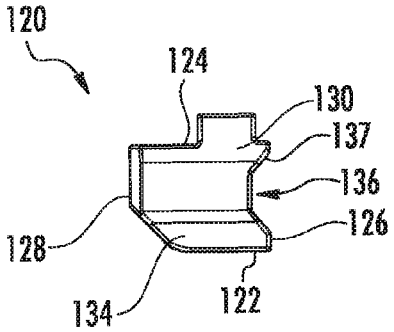
FIG. 8B is a front view of the exemplary embodiment of the first slider shown in FIG. 8A.

As can be seen in FIGS. 1, 8A and 8B, the first slider 120 may include a first side surface 122, a second side surface 124, a third side surface 126, a fourth side surface 128, an outer surface 130 and an inner surface 132. The outer surface 130 may include a ramped surface 134 for facilitating contact with the Neutral blade 42 of the two-bladed plug with ground pin. The third side surface 126 may include a recess 136 for receiving a portion of the first locking tab 180 therein. The first side surface 122 may be operatively associated with the second biasing member 192. For example, the first side surface 132 may include a borehole partially formed therein for receiving a portion of the second biasing member 192. Alternatively, the first side surface 122 may include a projection for coupling with the second biasing member 192. However, it should be appreciated that any mechanism now known or hereafter developed may be used to engage the biasing member 192.

Figure 9A:
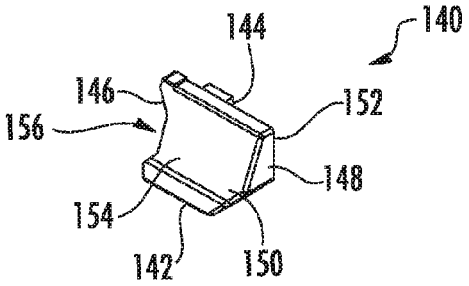
FIG. 9A is a perspective view of an exemplary embodiment of a second slider used in connection with the TR mechanism shown in FIG. 6.
Figure 9B:
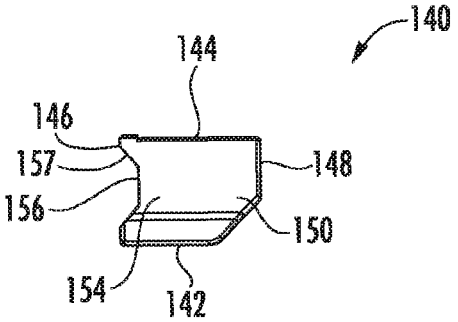
FIG. 9B is a front view of the exemplary embodiment of the second slider shown in FIG. 9A.

Similarly, referring to FIGS. 1, 9A and 9B, the second slider 140 may include a first side surface 142, a second side surface 144, a third side surface 146, a fourth side surface 148, an outer surface 150 and an inner surface 152. The outer surface 150 may include a ramped surface 154 for facilitating contact with the Hot blade 44 of a two-bladed plug with a ground pin. The third side surface 146 may include a recess 156 for receiving a portion of the second locking tab 185 therein. The first side surface 142 may be operatively associated with the third biasing member 194. For example, the first side surface 142 may include a borehole partially formed therein for receiving a portion of the biasing member 194. Alternatively, the first side surface 142 may include a projection for coupling with the biasing member 194. However, it should be appreciated that any mechanism now known or hereafter developed may be used to engage the biasing member 194.

While the first and second sliders 120, 140 have been described as generally having a rectangular shape, it is contemplated that the first and second sliders 120, 140 may have any shape necessary to block access to the Hot and Neutral internal conductive terminals. For example, as shown in connection with a 20-amp receptacle, the first slider 120 may have a larger size and shape to block the T-shaped Neutral opening 32 while the second slider may be smaller to block the generally rectangular shaped Hot opening 34. As will be appreciated by of ordinary skill in the art, the size and shape of the first and second sliders 120, 140 may be altered to accommodate different receptacles with different amperes and volts.

In the illustrated embodiment, the second and third biasing members 192, 194 contact the first and second sliders 120, 140, respectively, to bias the first and second sliders 120, 140 into the first or blocking position. The biasing members 190, 192, 194 may be any element capable of supply a biasing force. For example, as shown, the first, second and third biasing members 190, 192, 194 may be a coil spring, though this is not critical and other spring types or other resilient elements (e.g., elastomeric members, magnetic members) can be used without departing from the spirit of the disclosure.

Figure 10:
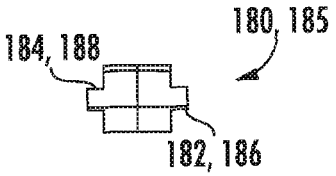
FIG. 10 is a front view of an exemplary embodiment of a locking tab used in connection with the TR mechanism shown in FIG. 6.

Referring to FIGS. 1 and 10, the first locking tab 180 may have a generally rectangular shape, although other shapes are contemplated. The first locking tab 180 may include a first end 182 and a second end 184. The first end 182 may be configured to selectively contact the second end 204 of the ground pin slider 200 when in the first or blocking position. The second end 184 of the first locking tab 180 may be configured to be received with the recess 136 formed in the third side surface 126 of the first slider 120.

Similarly, the second locking tab 185 may have a generally rectangular shape, although other shapes are contemplated. The second locking tab 185 may include a first end 186 and a second end 188. The first end 186 may be configured to selectively contact the second end 204 of the ground pin slider 200 when in the first or blocking position. The second end 188 of the second locking tab 185 may be configured to be received with the recess 156 formed in the third side surface 146 of the second slider 140.

In operation, if a children or some other user attempts to insert any one of a wide variety of objects into one of the blade openings 32, 34 formed in the cover 30 of the receptacle, the first and second sliders 120, 140 will block insertion of the object from engaging one of the internal conductive terminals located within the receptacle. Similarly, if a children or some other user attempts to insert a two-bladed plug (e.g., without a ground pin) into the three-bladed receptacle, the TR mechanism 100 will block insertion of the two-bladed plug from engaging the internal conductive terminals located within the receptacle. However, when a conventional two-bladed plug with a ground pin is properly inserted into the cover 30 of the receptacle through the blade or ground pin openings 32, 34, 36 formed in the cover 30, the first and second sliders 120, 140 and the ground pin slider 200 will move from the first or blocking position (FIGS. 1-3) to the second position (FIG. 5), allowing the Hot and Neutral blades 42, 44 and the ground pin 46 to engage the internal conductive terminals located in the receptacle and thus permit the flow of electricity.

FIG. 4 schematically illustrates a configuration of the TR mechanism 100 in which a ground pin 46 is initially inserted into the ground opening 36 in a manner previously described. Specifically, insertion of the ground pin 46 into the ground opening 36 formed in the cover 30 of the receptacle causes the ground pin 46 to contact the first end 202 of the ground pin slider 200. For example, the ground pin 46 may contact the ramped surface 203 formed on the first end 202 of the ground pin slider 200. As a result, the ground pin slider 200 is moved upward against the biasing force of the first biasing member 190. In turn, the first and second locking tabs 180, 185 are aligned with the stem 186 of the ground pin slider 200 resulting in the first and second locking tabs 180, 185 being free to move in a horizontal direction towards the stem 206.

The next step of the plug insertion process is shown in FIG. 5, which schematically illustrates the configuration of the TR mechanism 100 in which the Hot and Neutral blades 42, 44 of a two-bladed plug with a ground pin contact the outer surfaces 130, 150 of the first and second sliders 120, 140, respectively. For example, the Hot and Neutral blades 42, 44 may contact the outer ramped surfaces 134, 154 of the first and second sliders 120, 140, respectively. As a result, the first and second sliders 120, 140 are moved downwards against the biasing force of the second and third biasing members 192, 194, respectively. Movement of the first and second sliders 120, 140 also causes the first and second locking tabs 180, 185 to contact ramped surfaces 137, 157 formed in the recesses 136, 156 of the first and second sliders 120, 140, respectively, and thus moves the first and second locking tabs 180, 185 towards the stem 206 of the ground pin slider 200 and out of engagement with the recesses 136, 156 formed in the first and second sliders 120, 140. As a result, the Hot blade 42, the Neutral blade 44 and the ground pin 46 of the two-bladed plug with ground pin are permitted to be fully inserted into the receptacle and into full engagement with the internal conductive terminals causing electrically to flow.

Figure 2:
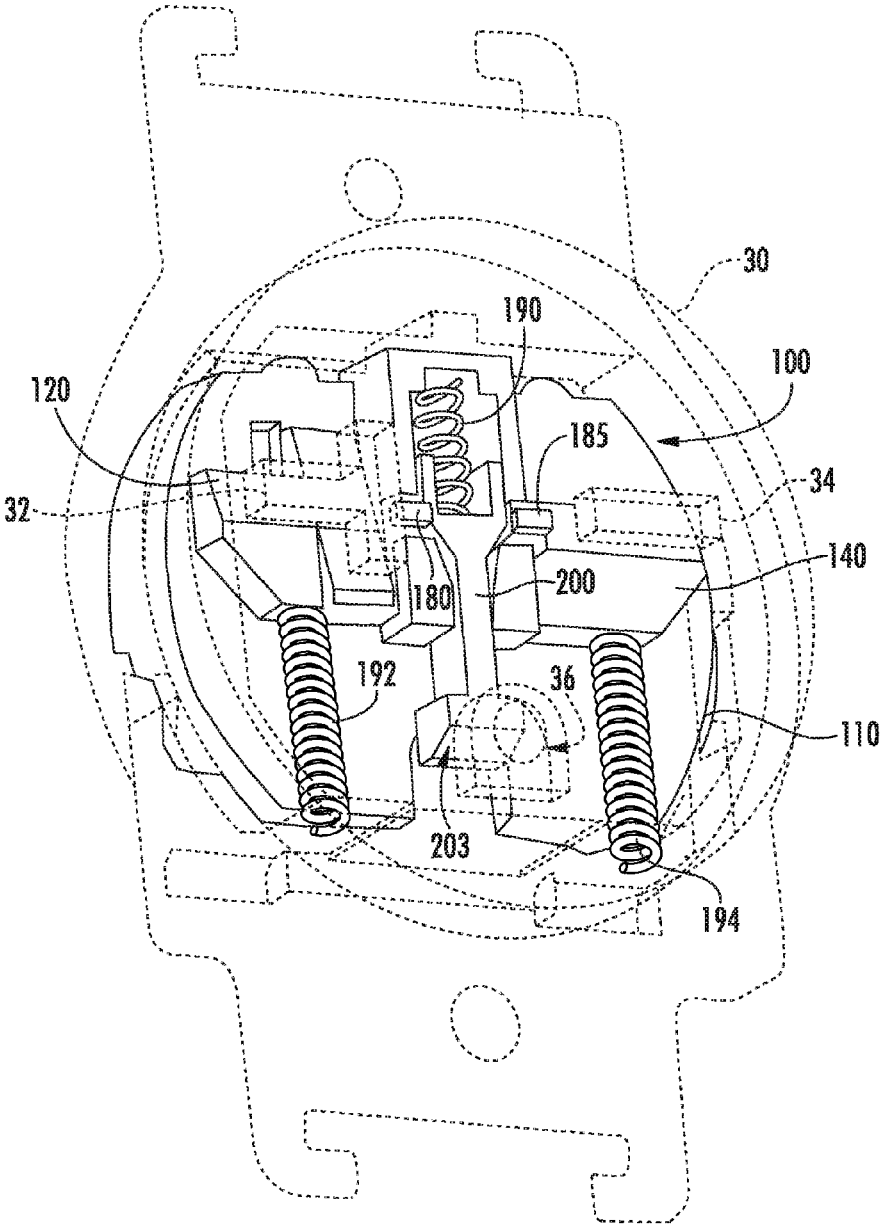
FIG. 2 is a front, perspective view of the TR mechanism of FIG. 1 with the cover shown in dotted lines, the TR mechanism shown in the first or blocking position.

When removing the two-bladed plug with ground pin, the Hot and Neutral blades 42, 44 will disengage from the TR mechanism 100 first, since they are shorter than the ground pin 46. As a result, the first and second biasing members 192, 194 bias the first and second sliders 120, 140 from their second position (FIG. 5) to their first, or blocking, position (FIGS. 1-3). Next, removal of the ground pin causes the first biasing member 190 to bias the ground pin slider 200 to move from its second position (FIGS. 4 and 5) to the first or blocking position (FIGS. 1-3). As a result, the transition area 207 formed on the ground pin slider 200 contacts the first and second locking tabs 180, 185 causing them to move back into the recesses 236, 256 formed in the first and second sliders 120, 140, respectively. As a result, the first and second locking tabs 180, 185 are once again constrained from moving due to the ground pin slider 200. In addition, the first and second locking tabs 180, 185 are received within the recesses 236, 256 formed in the first and second sliders 120, 140, which prevents the first and second sliders 120, 140 from moving until a two-bladed plug with ground pin is properly reinserted.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features. In addition, for the sake of convenience and clarity, terms such as "front," "rear," "outer," "inner," "top," "bottom," "upper," "lower," "upwards," "downwards," "vertical," "horizontal," "lateral," "longitudinal," "height," and "width" may have been used herein to describe the relative placement and orientation of the device and its various components, each with respect to the geometry and orientation of the device as it appears in the figures. While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. A tamper resistant (TR) mechanism for use in a receptacle, the receptacle including a cover having a plurality of blade openings and a ground pin opening for receiving a two-bladed electrical plug with a ground pin, the TR mechanism comprising:

a first slider associated with a first of the plurality of blade openings and a second slider associated with a second of the plurality of blade openings, each of the first and second sliders being movable from a first slider position to a second slider position, wherein, when in the first slider position, the first and second sliders block the plurality of blade openings, and, when in the second slider position, the first and second sliders permit passage of the two-bladed electrical plug thru the plurality of blade openings;

a first locking tab associated with the first slider and a second locking tab associated with the second slider, each of the first and second locking tabs movable from a first tab position to a second tab position, wherein, when in the first tab position, the first and second locking tabs prevent the first and second sliders, respectively, from moving to the second slider position;

a ground pin slider movable from a first ground pin slider position to a second ground pin slider position, the ground pin slider at least partially obstructing the ground pin opening when the ground pin slider is in the first ground pin slider position so that insertion of the ground pin causes the ground pin slider to move from the first ground pin slider position to the second ground pin slider position;

wherein, when the ground pin slider is in the second ground pin slider position, the first and second locking tabs are movable from the first tab position to the second tab position to permit the first and second sliders, respectively, to move from the first slider position to the second slider position;

wherein the first and second sliders are biased towards the first slider position, and the ground pin slider is biased towards the first ground pin slider position;

wherein the TR mechanism includes a vertical longitudinal axis, the ground pin slider being movable parallel to the vertical longitudinal axis when the ground pin slider moves from the first ground pin slider position to the second ground pin slider position, and the first and second sliders are movable parallel to the vertical longitudinal axis when the first and second sliders move from the first slider position to the second slider position; and wherein, the ground pin slider includes a first end, a second end and an intermediate stem disposed between the first end and the second end, wherein the first end is at least partially located within the ground pin opening when the ground pin slider is in the first ground pin slider position, and the second end of the ground pin slider is connected to a first biasing member for biasing the ground pin slider towards the first ground pin slider position, the second end of the ground pin slider preventing the first and second locking tabs from moving from the first tab position to the second tab position when in the first ground pin slider position.

2. The TR mechanism of claim 1, wherein the first end of the ground pin slider includes a ramped surface for contacting the ground pin.

3. The TR mechanism of claim 1, wherein the second end of the ground pin slider includes a recess for receiving a portion of a spring.

4. The TR mechanism of claim 1, wherein, when in the second ground pin slider position, the first and second locking tabs are aligned with the stem of the ground pin slider, and thus permitted to move laterally towards the stem of the ground pin slider so that the first and second locking tabs are permitted to move from the first tab position to the second tab position.

5. The TR mechanism of claim 4, wherein the second end of the ground pin slider has a width greater than a width of the stem so that when in the second ground pin slider position, the first and second locking tabs are permitted to move towards the stem.

6. The TR mechanism of claim 5, wherein the ground pin slider includes a sloped transition connecting the stem to the second end.

7. The TR mechanism of claim 1, wherein the first biasing member is a first coil spring and the first and second sliders are biased towards the first slider position by second and third coil springs.

8. The TR mechanism of claim 1, wherein the first and second sliders each include an outer sloped surface so that when the ground pin slider is in the second ground pin slider position, insertion of the two-bladed plug causes the first and second sliders to move to the second slider position.

9. The TR mechanism of claim 1, wherein, when in the first tab position, a first end of the first locking tab is in contact with the ground pin slider and a second end of the first locking tab is received within a recess formed in the first slider, and a first end of the second locking tab is in contact with the ground pin slider and a second end of the second locking tab is received within a recess formed in the second slider.

10. The TR mechanism of claim 9, wherein when in the second tab position, the first end of the first locking tab is aligned with the stem of the ground pin slider and the first end of the second locking tab is aligned with the stem of the of the ground pin slider so that the first and second sliders are movable from the first slider position to the second slider position.

11. The TR mechanism of claim 10, wherein, moving the first and second sliders from the first slider position to the second slider position causes the first and second sliders to contact the first and second locking tabs so that the first and second locking tabs move from the first tab position to the second tab position.

12. The TR mechanism of claim 1, further comprising a base for supporting the first and second sliders, the first and second locking tabs, and the ground pin slider.

13. The TR mechanism of claim 1, wherein, when in the first slider position, the first and second sliders block the plurality of blade openings to prevent access to first and second conductive terminals located in the receptacle, and, wherein when in the second slider position, the first and second sliders permit passage thru the plurality of blade openings so that the two-bladed electrical plug can contact the first and second conductive terminals located in the receptacle.

14. A tamper resistant (TR) mechanism for use in a receptacle, the receptacle including a cover having a plurality of blade openings and a ground pin opening for receiving a two-bladed electrical plug with a ground pin, the TR mechanism comprising:

first and second sliders movable from a first slider position to a second slider position, wherein, when in the first slider position, the first and second sliders block the plurality of blade openings, and, wherein when in the second slider position, the first and second sliders enable passage of the two-bladed electrical plugs thru the plurality of blade openings;

first and second locking tabs, each of the first and second locking tabs movable from a first tab position to a second tab position, wherein, when in the first tab position, the first and second locking tabs restrict the first and second sliders to prevent the first and second sliders from moving to the second slider position, respectively;

a ground pin slider movable from a first ground pin slider position to a second ground pin slider position, the ground pin slider at least partially obstructing the ground pin opening so that insertion of the ground pin causes the ground pin slider to move from the first ground pin slider position to the second ground pin slider position, wherein, when in the first ground pin slider position, the ground pin slider prevents the first and second locking tabs from moving to the second tab position;

wherein insertion of the two-bladed electrical plug with a ground pin causes the ground pin to contact the ground pin slider so that the ground pin slider moves from the first ground pin slider position to the second ground pin slider position and causes the two-blades to contact the first and second sliders so that the first and second sliders move from the first slider position to the second slider position, which causes the first and second locking tabs to move from the first tab position to the second tab position;

wherein the first and second sliders are biased towards the first slider position, and the ground pin slider is biased towards the first ground pin slider position so that upon removal of the two-bladed electrical plug with ground pin causes the first and second sliders to move to the first slider position and the ground pin slider to move to the first ground pin slider position, which causes the first and second locking tabs to move to the first tab position;

wherein the TR mechanism includes a vertical longitudinal axis, the ground pin slider being movable parallel to the vertical longitudinal axis when the ground pin slider moves from the first ground pin slider position to the second ground pin slider position, and at least one of the first and second sliders being movable parallel to the vertical longitudinal axis when the slider moves from the first slider position to the second slider position; and wherein, when in the first tab position, a first end of the first locking tab is in contact with the ground pin slider and a second end of the first locking tab is received within a recess formed in the first slider, and a first end of the second locking tab is in contact with the ground pin slider and a second end of the second locking tab is received within a recess formed in the second slider.

15. A tamper resistant (TR) mechanism for use in a receptacle, the receptacle including a cover having a plurality of blade openings and a ground pin opening for receiving a two-bladed electrical plug with a ground pin, the TR mechanism comprising:

at least one slider movable from a first slider position to a second slider position, wherein, when in the first slider position, the at least one slider blocks access to the plurality of blade openings, and, wherein when in the second slider position, the at least slider enables passage of the two-bladed electrical plug thru the plurality of blade openings;

at least one locking tab movable from a first tab position to a second tab position, wherein, when in the first tab position, the at least one locking tab prevents the at least one slider from moving to the second slider position;

a ground pin slider movable from a first ground pin slider position to a second ground pin slider position, the ground pin slider at least partially obstructing the ground pin opening so that insertion of the ground pin causes the ground pin slider to move from the first ground pin slider position to the second ground pin slider position;

wherein, when the ground pin slider is in the second ground pin slider position, the at least one locking tab is movable from the first tab position to the second tab position to permit the at least one slider to move from the first slider position to the second slider position;

wherein the at least one slider is biased towards the first slider position, and the ground pin slider is biased towards the first ground pin slider position;

wherein the TR mechanism includes a vertical longitudinal axis, the ground pin slider being movable parallel to the vertical longitudinal axis when the ground pin slider moves from the first ground pin slider position to the second ground pin slider position, and the at least one slider being movable parallel to the vertical longitudinal axis when the slider moves from the first slider position to the second slider position:

wherein, the ground pin slider includes a first end, a second end and an intermediate stem disposed between the first end and the second end, wherein the first end is at least partially located within the ground pin opening when the ground pin slider is in the first ground pin slider position, and the second end of the ground pin slider is connected to a first biasing member for biasing the ground pin slider towards the first ground pin slider position; and wherein, when in the first ground pin slider position, the second end of the ground pin slider prevents the at least one locking tab from moving from the first tab position to the second tab position.

16. The TR mechanism of claim 15, wherein the first end of the ground pin slider includes a ramped surface for contacting the ground pin and the second end of the ground pin slider includes a recess for receiving a portion of a spring.

17. The TR mechanism of claim 15, wherein, when in the second ground pin slider position, the at least one locking tab is aligned with the stem of the ground pin slider, and thus permitted to move laterally towards the stem of the ground pin slider so that the at least one locking tab is permitted to move from the first tab position to the second tab position.

18. The TR mechanism of claim 17, wherein the second end of the ground pin slider has a width greater than a width of the stem so that when in the second ground pin slider position, the at least one locking tab is permitted to move towards the stem.

19. The TR mechanism of claim 15, wherein the first biasing member a first coil spring and the at least one slider is biased towards the first slider position by a second coil spring, respectively.

20. The TR mechanism of claim 15, wherein the at least one slider includes an outer sloped surface so that when the ground pin slider is in the second ground pin slider position, insertion of the two-bladed plug causes the slider to move to the second slider position.

21. The TR mechanism of claim 15, wherein, when in the first tab position, a first end of the at least one locking tab is in contact with the ground pin slider and a second end of the locking tab is received within a recess formed in the at least one slider.

22. The TR mechanism of claim 21, wherein when in the second tab position, the first end of the locking tab is aligned with the stem of the ground pin slider so that the at least one slider is movable from the first slider position to the second slider position.

23. The TR mechanism of claim 22, wherein, moving the at least one slider from the first slider position to the second slider position causes the slider to contact the locking tab so that the locking tab moves from the first tab position to the second tab position.

* * * * *